US007175718B2

(12) United States Patent
Nobutoki et al.

(10) Patent No.: US 7,175,718 B2
(45) Date of Patent: Feb. 13, 2007

(54) RARE EARTH ELEMENT PERMANENT MAGNET MATERIAL

(75) Inventors: Hideharu Nobutoki, Tokyo (JP); Suguru Nagae, Tokyo (JP); Satoru Hayasi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 261 days.

(21) Appl. No.: 10/415,273

(22) PCT Filed: Jun. 19, 2001

(86) PCT No.: PCT/JP01/05202

§ 371 (c)(1),
(2), (4) Date: Apr. 28, 2003

(87) PCT Pub. No.: WO02/103719

PCT Pub. Date: Dec. 27, 2002

(65) Prior Publication Data

US 2004/0025975 A1 Feb. 12, 2004

(51) Int. Cl.
*H01F 1/057* (2006.01)

(52) U.S. Cl. ..... 148/302; 148/303; 75/244; 420/83; 420/121

(58) Field of Classification Search ..... 148/301, 148/302, 303; 420/83, 121
See application file for complete search history.

(56) References Cited

U.S. PATENT DOCUMENTS 4,770,723 A 9/1988 Sagawa et al.
4,814,139 A * 3/1989 Tokunaga et al. ..... 419/12
4,952,239 A * 8/1990 Tokunaga et al. ..... 148/302
4,983,232 A * 1/1991 Endoh et al. ..... 148/302
5,022,939 A * 6/1991 Yajima et al. ..... 148/302
5,405,455 A * 4/1995 Kusunoki et al. ..... 148/103
5,645,651 A * 7/1997 Fujimura et al. ..... 148/302
6,296,720 B1 10/2001 Yamamoto et al.
6,468,365 B1 10/2002 Uchida et al.
2002/0003007 A1 1/2002 Hirota et al.

FOREIGN PATENT DOCUMENTS

JP 2004942 1/1990
JP 4268050 9/1992
JP 6017200 1/1994
JP 6283316 10/1994
JP 11329810 11/1999

* cited by examiner

*Primary Examiner*—John P. Sheehan
(74) *Attorney, Agent, or Firm*—Leydig, Voit & Mayer, Ltd.

(57) ABSTRACT

A material for a rare earth permanent magnet having a high magnetic coercive force and a high residual magnetic flux density. 28 to 35% by weight of at least one rare earth element selected from the group consisting of neodymium, praseodymium, dysprosium, terbium, and holmium, 0.9 to 1.3% by weight of boron, 0.25 to 3% by weight of phosphorus, iron, and inevitable impurities. It can further comprise 0.1 to 3.6% by weight of cobalt and 0.02 to 0.25% by weight of copper.

12 Claims, 2 Drawing Sheets

RARE EARTH ELEMENT PERMANENT MAGNET MATERIAL

TECHNICAL FIELD

The present invention relates to a material for a rare earth permanent magnet having significantly improved magnetic characteristics.

BACKGROUND ART

Rare earth permanent magnets have been widely used in the field of electrical and electronic apparatus utilizing their excellent magnetic characteristics and also from economical reasons, and in recent years further improvement in their performance has been required. In an R—Fe—B rare earth permanent magnet, from among rare earth permanent magnets, Nd, which is a primary element, exists in greater abundance than Sm and a great amount of Co is not utilized so that material costs are lessened while the magnetic characteristics far exceed those of rare earth cobalt magnets and an R—Fe—B rare earth permanent magnet is therefore an excellent permanent magnet.

Previously, a variety of attempts have been made to improve the magnetic characteristics of such an R—Fe—B rare earth permanent magnet. Concretely, an example wherein Co is added so that the Curie temperature is raised (see Japanese unexamined patent publication No. 64733/1984), an example wherein Ti, V, Ni, Bi and the like, are added in order to obtain a stable magnetic coercive force (see Japanese unexamined patent publication No.132104/1984), an example wherein 0.02 to 0.5 atomic % of Cu is added so that the magnetic coercive force is improved and the range of the optimum temperature for heat treatment is extended and, thereby, the efficiency of manufacture is improved (see Japanese unexamined patent publication No. 219143/1989), an example wherein 0.2 to 0.5 % by atom of Cr is added so that resistance to corrosion is improved (see Japanese unexamined patent publication No. 2 19142/1989), and the like, have been reported.

In all of the above described reports a new element is added to an R—Fe—B rare earth permanent magnet and, thereby, further improvement of magnetic characteristics has been attempted. In most cases wherein another element is newly added, however, the residual magnetic flux density (Br) is lowered even in the case that the magnetic coercive force (iHc) is increased. Accordingly, practical improvement of the magnetic characteristics has been difficult to achieve.

The purpose of the present invention is to provide a material for a rare earth permanent magnet having a high magnetic coercive force and a high residual magnetic flux density.

DISCLOSURE OF INVENTION

As the result of assiduous research concerning the types of elements, from among a large number of elements, newly added to an R—Fe—B rare earth permanent magnet and the amounts thereof, it was found that the magnetic coercive force and the residual magnetic flux density both increase in a composition wherein a certain amount of P is added and, thereby, the present invention has been realized.

That is to say, the first material for the permanent magnet of the present invention relates to a material for a rare earth permanent magnet comprising 28 to 35% by weight of at least one rare earth element selected from the group consisting of neodymium Nd, praseodymium Pr, dysprosium Dy, terbium Tb and holmium Ho, 0.9 to 1.3% by weight of B, 0.25 to 3% by weight of P and Fe.

The second material for a permanent magnet of the present invention relates to a material for a rare earth permanent magnet that further comprises 0.1 to 3.6% by weight of cobalt Co and 0.02 to 0.25% by weight of copper Cu in the first material for a permanent magnet.

The third material for a permanent magnet of the present invention relates to a material for a rare earth permanent magnet wherein a content of phosphorus P is 0.3 to 2.5% by weight in the first material for a permanent magnet.

The fourth material for a permanent magnet of the present invention relates to a material for a rare earth permanent magnet wherein a content of phosphorus P is 0.3 to 2.5% by weight in the second material for a permanent magnet.

The fifth material for a permanent magnet of the present invention relates to a material for a rare earth permanent magnet wherein a main phase is an intermetallic compound having a tetragonal structure in the first material for a permanent magnet.

The sixth material for a permanent magnet of the present invention relates to a material for a rare earth permanent magnet wherein a main phase is an intermetallic compound having a tetragonal structure in the second material for a permanent magnet.

The seventh material for a permanent magnet of the present invention relates to a material for a rare earth permanent magnet wherein a main phase is an intermetallic compound having a tetragonal structure in the third material for a permanent magnet.

The eighth material for a permanent magnet of the present invention relates to a material for a rare earth permanent magnet wherein a main phase is an intermetallic compound having a tetragonal structure in the fourth material for a permanent magnet.

BEST MODE FOR CARRYING OUT THE INVENTION

Figure 1:
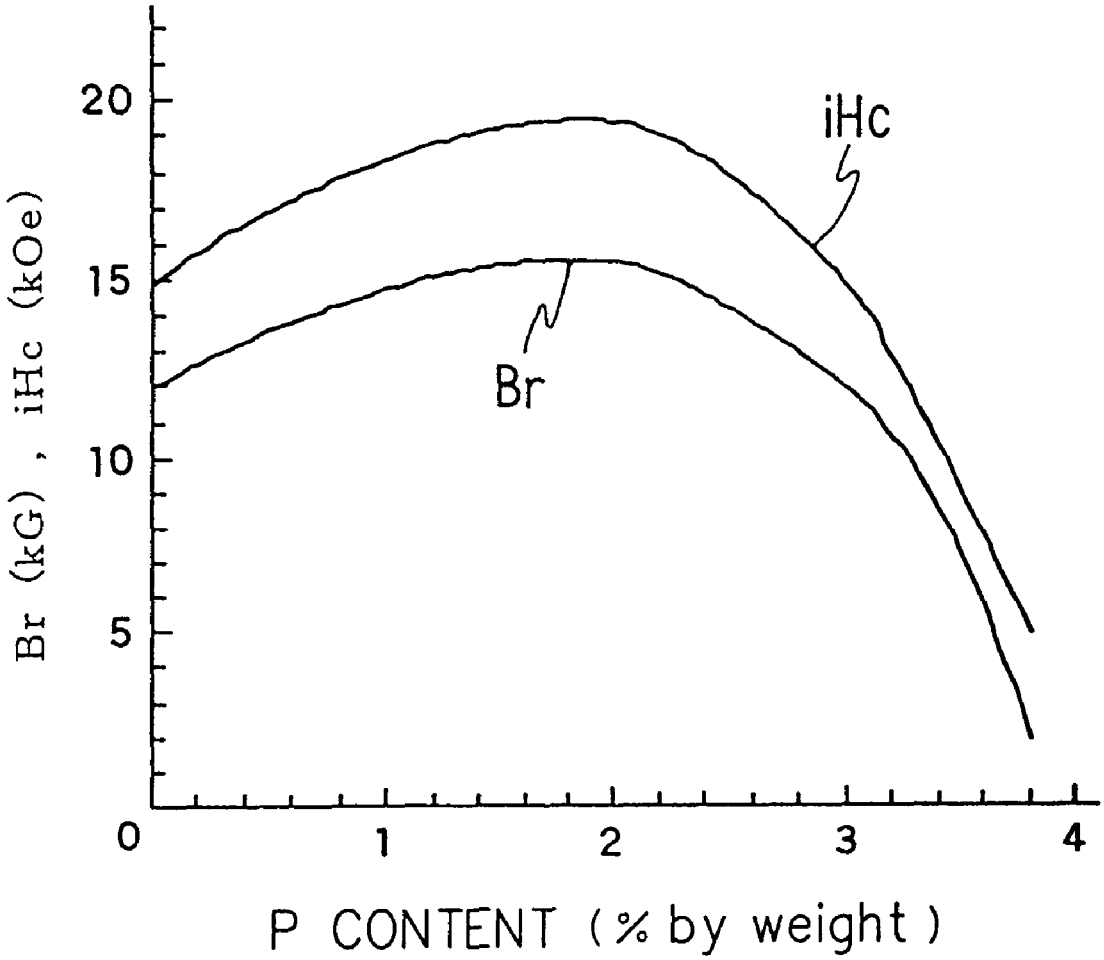
FIG. 1 is a graph showing the relationships between the P content and the magnetic coercive force (iHc) and between the P content and the residual magnetic flux density (Br)

A material for a rare earth permanent magnet of the present invention comprises a rare earth element, boron B, phosphorus P, iron Fe and inevitable impurities, wherein a portion of Fe can be replaced with cobalt Co or with copper Cu. The material for a rare earth permanent magnet of the present invention has a high residual magnetic flux density and a high magnetic coercive force due to the above specific composition.

A rare earth permanent magnet of the present invention comprises at least one rare earth element (hereinafter referred to as R) selected from the group consisting of neodymium Nd, praseodymium Pr, dysprosium Dy, terbium Tb and holmium Ho, of which a content is in a range of 28 to 35% by weight. In the case that an R content is less than 28% by weight, the magnetic coercive force becomes significantly reduced and in the case that an R content exceeds 35% by weight, the residual magnetic flux density becomes significantly reduced. More preferably, the upper limit of an R content is 33% by weight and the lower limit is 30% by weight.

P content in the permanent magnet of the present invention is in a range of 0.9 to 1.3 % by weight. In the case of less than 0.9 % by weight, the magnetic coercive force becomes significantly reduced and in the case of greater than 1.3 % by weight, the residual magnetic flux density becomes significantly reduced. More preferably, the upper limit of a B content is 1.2% by weight and the lower limit is 1.0% by weight. A=P content in the permanent magnet of the present invention is in a range of 0.25 to 3% by weight. In the case of less than 0.25% by weight, the residual magnetic flux density becomes significantly reduced and in the case of greater than 3% by weight, the magnetic coercive force becomes significantly reduced. Furthermore, in the case that the content exceeds 3% by weight, a stable tetragonal structure cannot be obtained so that the ratio of the tetragonal structure becomes reduced, which is undesirable. Because of the above described reasons, it is more preferable to add 0.3 to 2.5% by weight of P.

It is preferable for an Fe content in the permanent magnet of the present invention to be 58 to 80% by weight. In the case that an Fe content is less than 58% by weight, the residual magnetic flux density tends to become greatly reduced and in the case of greater than 80% by weight, the magnetic coercive force tends to become significantly reduced. More preferably, the upper limit of an Fe content is 75% by weight, in particular, 72% by weight, and the lower limit is 62% by weight. In the case that a portion of the Fe is replaced with Co and Cu, the Fe content can be set from 54 to 78% by weight.

In the case that a portion of the Fe in the permanent magnet of the present invention is replaced with Co, an improvement in the Curie temperature (Tc) is obtained. According to the present invention, the Co content can be in a range of 0.1 to 3.6% by weight. In the case of less than 0.1% by weight, the effect of significant improvement in the Curie temperature is not obtained and in the case of greater than 3.6% by weight, the cost becomes prohibitive. More preferably, the upper limit of a Co content is 3.2% by weight and the lower limit is 0.5% by weight.

As described above, Cu in the permanent magnet of the present invention enhances the magnetic characteristics of an R—Fe—B rare earth permanent magnet. According to the present invention, a Cu content can be in a range of 0.02 to 0.25% by weight. In the case of less than 0.02% by weight, the magnetic coercive force is not significantly increased and in the case of greater than 0.25% by weight, the residual magnetic flux density becomes greatly reduced. More preferably, the upper limit of a Cu content is 0.2% by weight and the lower limit is 0.06% by weight.

It is preferable for the ratio of a tetragonal structure included in the entirety of the permanent magnet of the present invention to be 50% by weight and to be, in particular, 70% by weight, or greater. In the case that the ratio of a tetragonal structure is less than 50% by weight, the magnetic coercive force tends to become smaller.

The permanent magnet of the present invention usually has a Curie temperature (Tc) of from 380 to 600° C. and has a residual magnetic flux density (Br) of from 11 to 18 kG and a magnetic coercive force (iH) of from 14 to 21 kOe at 25° C.

A material for a rare earth permanent magnet of the present invention may be manufactured in accordance with a general manufacturing method for an Nd magnet. One example thereof is shown below.

First, Nd, Fe, B, P and other elements to be added (Co, Cu, or the like) as materials, are mixed with each other to predetermined ratios, and are melted under high frequency so as to cast an alloy. In this case, Co or Cu used in manufacture may be contained in the Fe used as a material.

Then, the obtained alloy is roughly pulverized by means of a jaw crusher or a Brown mill and, after that, is finely pulverized according to a wet method in an organic solvent using an attritor or a ball mill, or according to a dry method by means of a jet mill using a nitrogen gas. Though the grain diameter of the fine powder is not specifically limited, an average diameter of 0.5 to 5 μm is preferable.

The obtained fine powder is oriented in the magnetic field direction in a magnetic field of approximately 10 kOe and is compressed under a pressure of approximately 0.2 to 2 ton/cm$^2$. Then, the form resulting from compression is sintered in a high vacuum or in an inert gas at 1000 to 1400° C. for one hour to two hours and, in addition, is heat treated at a temperature (approximately 800 to 1200 ° C.) lower than the temperature for sintering. Thereby, the material for a rare earth permanent magnet of the present invention is obtained.

Then, further processes and surface treatments are applied to the above described material for a rare earth permanent magnet so as to obtain a rare earth permanent magnet.

Here, a microscopic amount, 0.2% by weight, or less, of La, Ce, Sm, Ni, Mn, Si, Ca, Mg or S, which are inevitable impurities contained in materials used in the manufacturing of a material for a rare earth permanent magnet or mixed in during the manufacturing process, does not deteriorate the effects of the present invention.

In the following, the present invention is concretely described according to Examples but the present invention is not limited to these Examples.

EXAMPLES 1 to 3 and COMPARATIVE EXAMPLES 1 to 3

Nd, electrolytic iron, ferroboron and iron phosphide are utilized as starting materials. Then, these materials are mixed into a composition of 30Nd—BAL.Fe—1B-XP (X is a numeric value of from 0 to 5) according to weight percent (% by weight) and, after that, are melted under high frequency in an aluminum crucible, and are poured into a water-cooled copper mold so as to obtain an ingot having a various composition. Next, this ingot is roughly pulverized in a Brown mill and, in addition, is finely pulverized in a jet mill having a flow of nitrogen gas so as to obtain a microscopic powder having an average grain diameter of approximately 1 μm and, then, this microscopic powder and 0.07% by weight of stearic acid, providing lubrication, are mixed in a V-type mixer in an atmosphere of nitrogen gas.

After that, this microscopic powder is filled into a metal mold of a molding machine and is oriented in a magnetic field of 10 kOe and, then, is compressed under a pressure of 1.2 ton/cm$^2$ in the direction perpendicular to the magnetic field. The obtained form is sintered in an Ar atmosphere for two hours at 1200° C. and, then, cooled and, in addition, is heat treated in an Ar atmosphere for one hour at 800° C. so as to prepare a material for a rare earth permanent magnet having various composition wherein a P content differs.

Here, the materials are moved in a nitrogen atmosphere during the entirety of the process from the formation of an ingot up to sintering in order to reduce the oxygen content.

The Curie temperature, the magnetic coercive force (iHc) and the residual magnetic flux density (Br) are measured in the material for a rare earth permanent magnet and all of the results obtained are shown in FIG. 1 and in Table 1.

Consequently, as is seen in Table 1, the Curie temperature (Tc) is improved by replacing a portion of Fe with P. In addition, as is seen in FIG. 1 and Table 1, the magnetic coercive force can be increased without reducing the residual magnetic flux density in the material having a P content of up to 3% by weight in comparison with the material having no P. In the case that the amount of addition of P exceeds 3% by weight, the residual magnetic flux density and the magnetic coercive force are both reduced in comparison with the material to which P is not added. Furthermore, in the case that P content is 2% by weight, the residual magnetic flux density can be increased by 3.6 kG and the magnetic coercive force can be increased by 4.5 kOe so that the magnetic characteristics are greatly improved.

TABLE 1

| | Compostion | Residual magnetic flux density (kG) | Magnetic coercive force (kOe) | Curie Temperature (° C.) |
|---|---|---|---|---|
| Com. Ex. 1 | 30Nd-69Fe-1B | 12.0 | 14.8 | 305 |
| Ex. 1 | 30Nd-68Fe-1B-1P | 14.9 | 18.4 | 402 |
| Ex. 2 | 30Nd-67Fe-1B-2P | 15.6 | 19.3 | 425 |
| Ex. 3 | 30Nd-66Fe-1B-3P | 11.8 | 16.6 | 297 |
| Com. Ex. 2 | 30Nd-65Fe-1B-4P | — | 2.2 | — |
| Com. Ex. 3 | 30Nd-64Fe-1B-5P | — | — | — |

Figure 2:
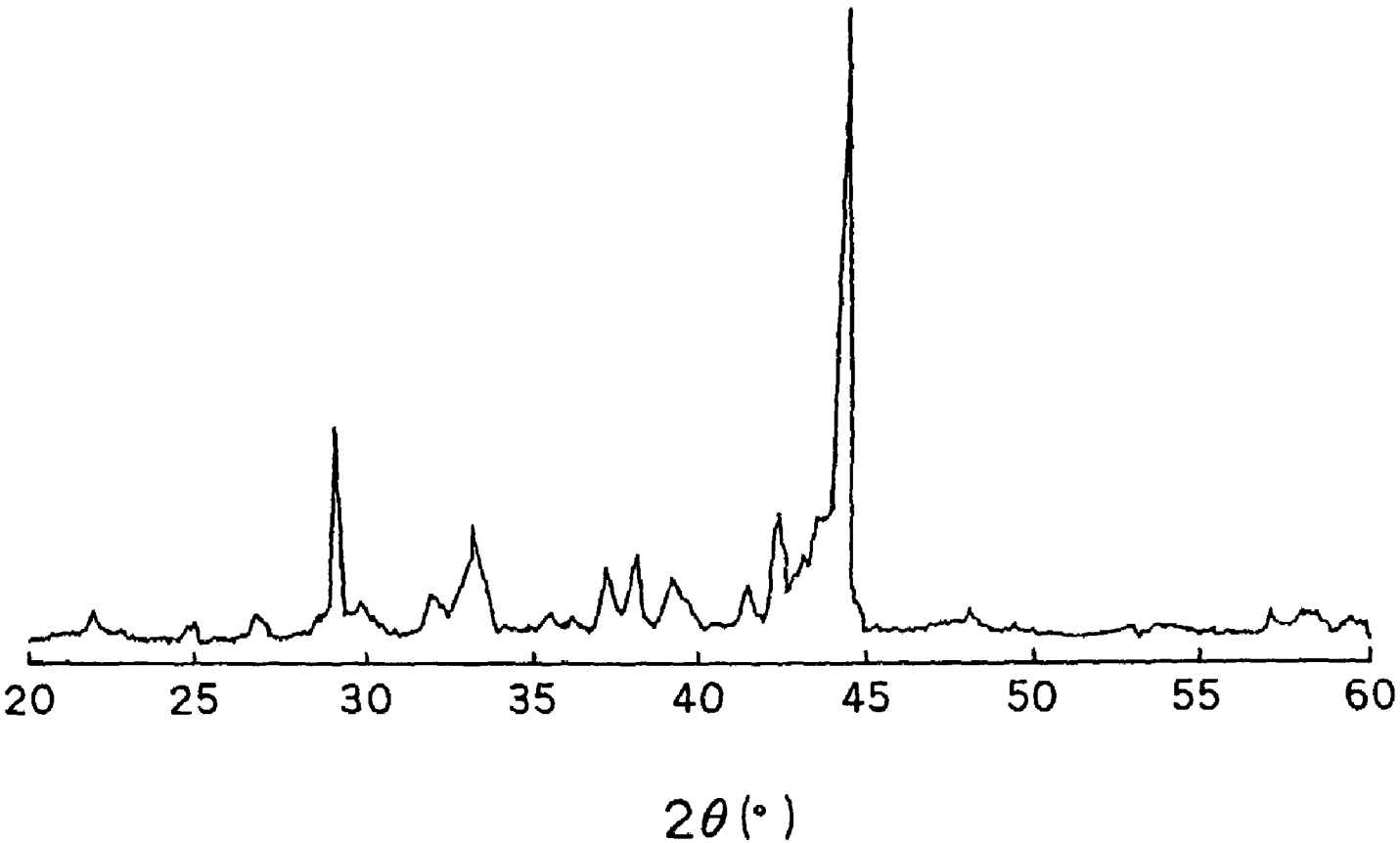
FIG. 2 is an X-ray diffraction graph of a material for a rare earth permanent magnet in Example 2 of the present invention.

In addition, FIG. 2 shows the crystal structure of the obtained sample (a P content is 2% by weight) as a result of X-ray diffraction using a CuK α-ray. From this diffraction result, the main phase is confirmed to be a $Nd_2Fe_{14}B$-type tetragonal crystal structure.

EXAMPLE 4

Nd, Dy, electrolytic iron, Co, ferroboron, iron phosphide and Cu are utilized as starting materials. Then, these materials are mixed into a composition of 30Nd-1Dy-62.8Fe-3Co-1B-0.2Cu-2P according to weight percent (% by weight) in accordance with the same method as in Example 1 and, thereby, a material for a rare earth permanent magnet is prepared.

The Curie temperature (Tc), the magnetic coercive force (iHc) and the residual magnetic flux density (Br) in this material for a rare earth permanent magnet are measured and the Curie temperature is 450° C., the magnetic coercive force is 16.2 kG and the residual magnetic flux density is 20.3 kOe and, therefore, a great increase in the magnetic characteristics is achieved.

In addition, it is confirmed that the diffraction graph shows the main phase having a $Nd_2Fe_{14}B$-type tetragonal crystal structure as a result of X-ray diffraction carried out on the crystal structure of the obtained sample using a CuK α-ray.

INDUSTRIAL APPLICABILITY

According the first to eighth permanent magnets of the present invention, materials for a rare earth permanent magnet having a high magnetic coercive force and a high residual magnetic flux density can be obtained.

The invention claimed is:

1. A rare earth permanent magnet material comprising 28 to 35% by weight of at least one rare earth element selected from the group consisting of neodymium, praseodymium, dysprosium, terbium, and holmium, 0.9 to 1.3% by weight of boron, 0.25 to 3% by weight of phosphorus, and iron, having a residual magnetic flux density of 11 to 18 kG, a magnetic coercive force of 14 to 21 kOe at 25° C., and produced by sintering at a temperature in a range from 1,0000° C. to 1,4000° C.

2. The rare earth permanent magnet material of claim 1, further comprising 0.1 to 3.6% by weight of cobalt and 0.02 to 0.25% by weight of copper.

3. The rare earth permanent magnet material of claim 1, including 0.3 to 2.5% by weight of phosphorus.

4. The rare earth permanent magnet material of claim 2, including 0.3 to 2.5% by weight of phosphorus.

5. The rare earth permanent magnet material of claim 1, wherein the material includes a main phase that is an intermetallic compound having a tetragonal structure.

6. The rare earth permanent magnet material of claim 2, wherein the material includes a main phase that is an intermetallic compound having a tetragonal structure.

7. The rare earth permanent magnet material of claim 3, wherein the material includes a main phase that is an intermetallic compound having a tetragonal structure.

8. The rare earth permanent magnet material of claim 4, wherein the material includes a main phase that is an intermetallic compound having a tetragonal structure.

9. A rare earth permanent magnet material consisting essentially of 28 to 35% by weight of at least one rare earth element selected from the group consisting of neodymium, praseodymium, dysprosium, terbium, and holmium, 0.9 to 1.3% by weight of boron, 0.25 to 3% by weight of phosphorus, 58 to 80% by weight of iron, 0.1 to 3.6% by weight of cobalt, and 0.02 to 0.25% by weight of copper, and having a residual magnetic flux density of 11 to 18 kG, a magnetic coercive force of 14 to 21 kOe at 25°C.

10. The rare earth permanent magnet material of claim 9, including 0.3 to 2.5% by weight of phosphorus.

11. The rare earth permanent magnet material of claim 9, wherein the material includes a main phase that is an intermetallic compound having a tetragonal structure.

12. The rare earth permanent magnet material of claim 3, wherein the material includes a main phase that is an intermetallic compound having a tetragonal structure.

* * * * *